US009473844B2

(12) United States Patent
Horikawa

(10) Patent No.: US 9,473,844 B2
(45) Date of Patent: Oct. 18, 2016

(54) HEADPHONES AND EAR PAD

(71) Applicant: D&M Holdings, Inc., Kanagawa (JP)

(72) Inventor: Osamu Horikawa, Kanagawa (JP)

(73) Assignee: D&M Holdings, Inc., Kanagawa (JP)

( * ) Notice: Subject to any disclaimer, the term of this patent is extended or adjusted under 35 U.S.C. 154(b) by 23 days.

(21) Appl. No.: 14/370,946

(22) PCT Filed: Nov. 30, 2012

(86) PCT No.: PCT/JP2012/081029

§ 371 (c)(1),
(2) Date: Jul. 7, 2014

(87) PCT Pub. No.: WO2013/099516

PCT Pub. Date: Jul. 4, 2013

(65) Prior Publication Data

US 2015/0281828 A1 Oct. 1, 2015

(30) Foreign Application Priority Data

Dec. 28, 2011 (JP) ..... 2011-288541

(51) Int. Cl.
*H04R 1/10* (2006.01)
*H04R 5/033* (2006.01)

(52) U.S. Cl.
CPC ..... *H04R 1/1058* (2013.01); *H04R 1/1008* (2013.01); *H04R 1/1066* (2013.01); *H04R 1/1075* (2013.01); *H04R 5/0335* (2013.01)

(58) Field of Classification Search
CPC .. H04R 1/1008; H04R 5/033; H04R 1/1066; H04R 1/1016; H04R 1/1058; H04R 5/0335; H04R 1/1075; H04R 1/105
USPC ..... 381/370, 371
See application file for complete search history.

(56) References Cited

U.S. PATENT DOCUMENTS 2,856,469 A * 10/1958 Morse ..... H04M 1/03 181/129
3,602,329 A * 8/1971 Bauer ..... H04R 1/225 181/129

(Continued)

FOREIGN PATENT DOCUMENTS

EP 1921889 A1 5/2008
EP 1971181 A2 9/2008

(Continued)

OTHER PUBLICATIONS

International Preliminary Report on Patentability for PCT/JP2012/081029; dated Jul. 1, 2014.

(Continued)

*Primary Examiner* — Davetta W Goins
*Assistant Examiner* — Oyesola C Ojo
(74) *Attorney, Agent, or Firm* — Peter A. Nieves; Sheehan Phinney Bass & Green PA

(57) ABSTRACT

[Problem] To prevent sound leakage through gaps between the wearing surface side of ear pads and areas around the ears when headphones are worn and used by a user. [Solution] For headphones that have ear pads which are attached to the surfaces of housing sections, each having a built-in speaker driver for outputting an audio signal as sound, which come in contact with the ears of a listener, convex sections in the form of gradually curved surfaces are provided in the wearing surface regions of the ear pads that come in contact with an upper anterior side of the head of the listener and a lower posterior side of the head of the listener, whereby the ear pads are shaped to fit well to the areas around the ears of the user without forming any gaps when the ear pads are worn.

15 Claims, 5 Drawing Sheets

(56) References Cited

U.S. PATENT DOCUMENTS

| | | | | |
|---|---|---|---|---|
| 4,958,697 | A * | 9/1990 | Moody | A42B 3/166 181/129 |
| 6,148,446 | A * | 11/2000 | Leight | A61F 11/14 128/867 |
| 8,374,373 | B2 * | 2/2013 | Sapiejewski | H04R 1/1008 181/129 |
| 2004/0252487 | A1 * | 12/2004 | McCullough | F21V 33/0056 362/105 |
| 2009/0110226 | A1 * | 4/2009 | Ishida | H04R 1/1008 381/370 |
| 2012/0195454 | A1 * | 8/2012 | Nishihara | H04R 1/1091 381/373 |

FOREIGN PATENT DOCUMENTS

| | | | |
|---|---|---|---|
| JP | 1976-112533 | | 9/1976 |
| JP | 133627/1977 | | 10/1977 |
| JP | 053428/1979 | | 4/1979 |
| JP | 08307983 | A | 11/1996 |
| JP | 2003-333678 | | 11/2003 |
| JP | 2003-333678 | A | 11/2003 |
| JP | 200719957 | A | 1/2007 |
| JP | 2008-193609 | | 8/2008 |
| JP | 2012-054780 | | 3/2012 |

OTHER PUBLICATIONS

International Search Report for PCT/JP2012/081029; dated Feb. 12, 2013.

Extended European Search Report for Application 12863983.8 dated Jul. 17, 2015.

* cited by examiner

HEADPHONES AND EAR PAD

CROSS-REFERENCE TO RELATED APPLICATIONS

This application is the National Stage of International Application No. PCT/JP2012/081029, filed Nov. 30, 2012, which claims the benefit of Japanese Patent Application No. 2011-288541, filed Dec. 28, 2011. The contents of these prior applications are incorporated by reference herein in their entirety.

TECHNICAL FIELD

The present invention relates to a headphone to be connected, for example, to an audio reproducing device and used for listening to music, voice, and the like. The present invention also relates to an ear pad.

BACKGROUND ART

As an example of headphone devices to be used for listening to music, voice, and the like while being attached over the head and fitted to the right and left ears of a user, there has been generally known a headphone device including housings to be fitted respectively to the right and left ears, and a headband for connecting the housings to each other, in which the headband is attached over the head while supporting the right and left housings.

The right and left housings each have a fitting surface to be brought into abutment on a periphery of corresponding one of the right and left ears. On the fitting surface, an ear pad is provided so as to allow the right and left housings to be comfortably fitted while preventing sound leakage to the surroundings and noise from an outside.

In many types of the ear pads to be used for headphones, the fitting surface to be brought into abutment on a periphery of the ear is formed to be flat. In a case where the fitting surface of the ear pad is flat, when the user puts on a headphone, gaps may be formed between the periphery of the ear on the head and the fitting surface of the headphone due to ridges and depressions around the ear on the head. In order to close the gaps, there have been proposed headphones having structure in which the fitting surface of the ear pad is fitted at an angle to a periphery of the ear (see Patent Literatures 1 and 2).

CITATION LIST

Patent Literature

[PTL 1] JP 05-085190 U
[PTL 2] JP 2008-124734 A

SUMMARY OF INVENTION

Technical Problems

The structure in which the fitting surface of the ear pad is fitted at an angle as disclosed in Patent Literatures 1 and 2 is insufficient as a measure against the ridges and depressions around the ear. As a result, the gaps between the fitting surface of the ear pad and the periphery of the ear may be formed to cause the sound leakage to the outside. FIG. 5 is a view as viewed from obliquely behind the head, for illustrating an example of a wearing state in which an ear pad of a related-art headphone device forms such a gap.

Specifically, as in the example of the figure, under a state in which a user wears a headphone device 10 including housings 20, a head pad 30, and ear pads 40, sound leakage occurs due to gaps formed at parts from behind the ear to the neck. Further, low frequency signal components of sound that the user listens to are attenuated due to the sound leakage, which may cause deterioration in sound quality. Also at other parts such as an upper front part of the ear, as indicated by the arrow in FIG. 5, a gap is formed between a fitting surface of the ear pad 40 and a periphery of the ear, which also causes problems of sound leakage and deterioration in sound quality.

It is therefore an object of the present invention to provide a headphone capable of preventing a fitting surface of an ear pad from forming gaps without deteriorating wearing comfort at the time of wearing the headphone so as to prevent sound leakage to an outside and deterioration in sound quality, such as lack of sound pressure in a low frequency band of sound that a user listens to.

Further, it is another object of the present invention to provide an ear pad having a structure capable of easily forming protrusions and depressions for preventing a fitting surface of a headphone from forming gaps.

Solution to Problems

According to one embodiment of the present invention, there is provided a headphone, including an ear pad fitted onto a surface of a housing to be brought into abutment on an ear of a listener, the housing including a built-in speaker driver for outputting an audio signal as sound, in which the ear pad includes a protruding portion on a surface thereof, which is to be brought into abutment on an upper front part of a head of the listener.

According to another embodiment of the present invention, there is provided a headphone, including an ear pad fitted onto a surface of a housing to be brought into abutment on an ear of a listener, the housing including a built-in speaker driver for outputting an audio signal as sound, in which the ear pad includes a protruding portion on a surface thereof, which is to be brought into abutment on a lower rear part of a head of the listener.

According to one embodiment of the present invention, there is provided an ear pad for a headphone, which is fitted onto a surface of a housing to be brought into abutment on an ear of a listener, the housing including a built-in speaker for outputting an audio signal as sound, the ear pad including a protruding portion on a surface thereof, which is to be brought into abutment on an upper front part of a head of the listener.

According to another embodiment of the present invention, there is provided an ear pad for a headphone, which is fitted onto a surface of a housing to be brought into abutment on an ear of a listener, the housing including a built-in speaker for outputting an audio signal as sound, the ear pad including a protruding portion on a surface thereof, which is to be brought into abutment on a lower rear part of a head of the listener.

According to one embodiment of the present invention, there are provided a headphone and an ear pad. The ear pad for the headphone is fitted onto a surface of a housing to be brought into abutment on an ear of a listener. The housing includes a built-in speaker for outputting an audio signal as sound. The ear pad is formed into a polygonal shape including a monotonic slope formed on a fitting surface on one side of the polygonal shape.

Further, in the headphone and the ear pad according to the one embodiment of the present invention, the polygonal shape includes corners each corresponding to a peak between slopes of two sides that form corresponding one of the corners.

Further, in the headphone and the ear pad according to the one embodiment of the present invention, the polygonal shape includes corners each corresponding to a turning point between slopes of two sides that form corresponding one of the corners.

Advantageous Effects of Invention

According to the headphone and the ear pad of one embodiment of the present invention, the ear pad of the headphone can be fitted without gaps or without deteriorating wearing comfort of the headphone, to thereby prevent sound leakage. Further, deterioration in sound quality, which may be caused by the sound leakage, can also be prevented.

DESCRIPTION OF EMBODIMENT

Figure 1:
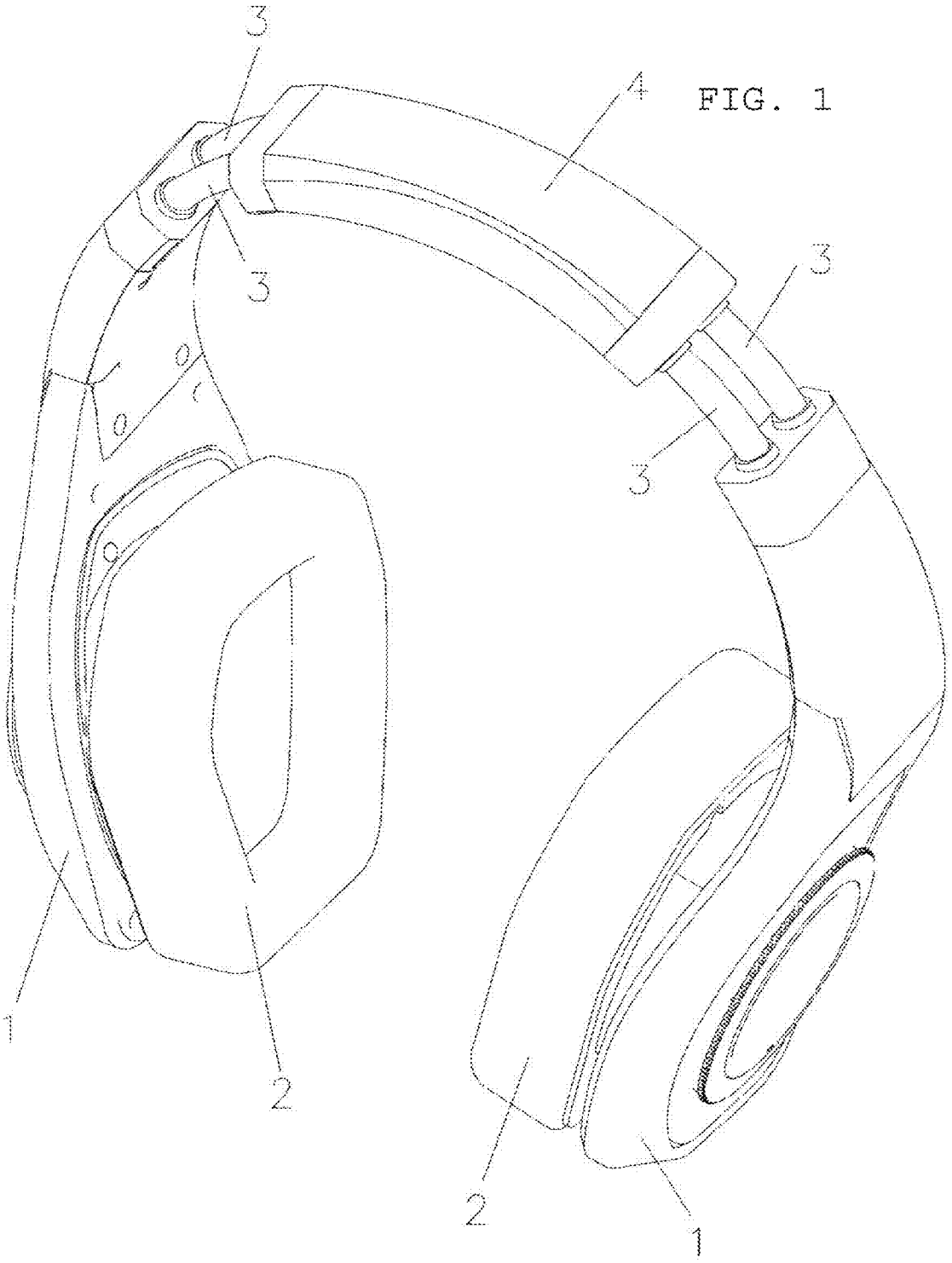
FIG. 1 is a view illustrating a schematic configuration of a headphone device according to an embodiment of the present invention.

FIG. 1 is a view illustrating a schematic configuration of a headphone device according to an embodiment of the present invention. In the headphone device to be used for listening to music, voice, and the like while being attached over the head and fitted to the right and left ears of a user, right and left housings 1 respectively receive built-in speaker drivers (not shown), and include ear pads 2 to be fitted respectively to the right and left ears.

Pipes 3 and a head pad 4 serve as a head band, and connect the right and left housings 1 to each other. The head pad 4 includes therein a cushion member (not shown) so that the headphone device is attached over and supported by the parietal region of the user.

Figure 2:
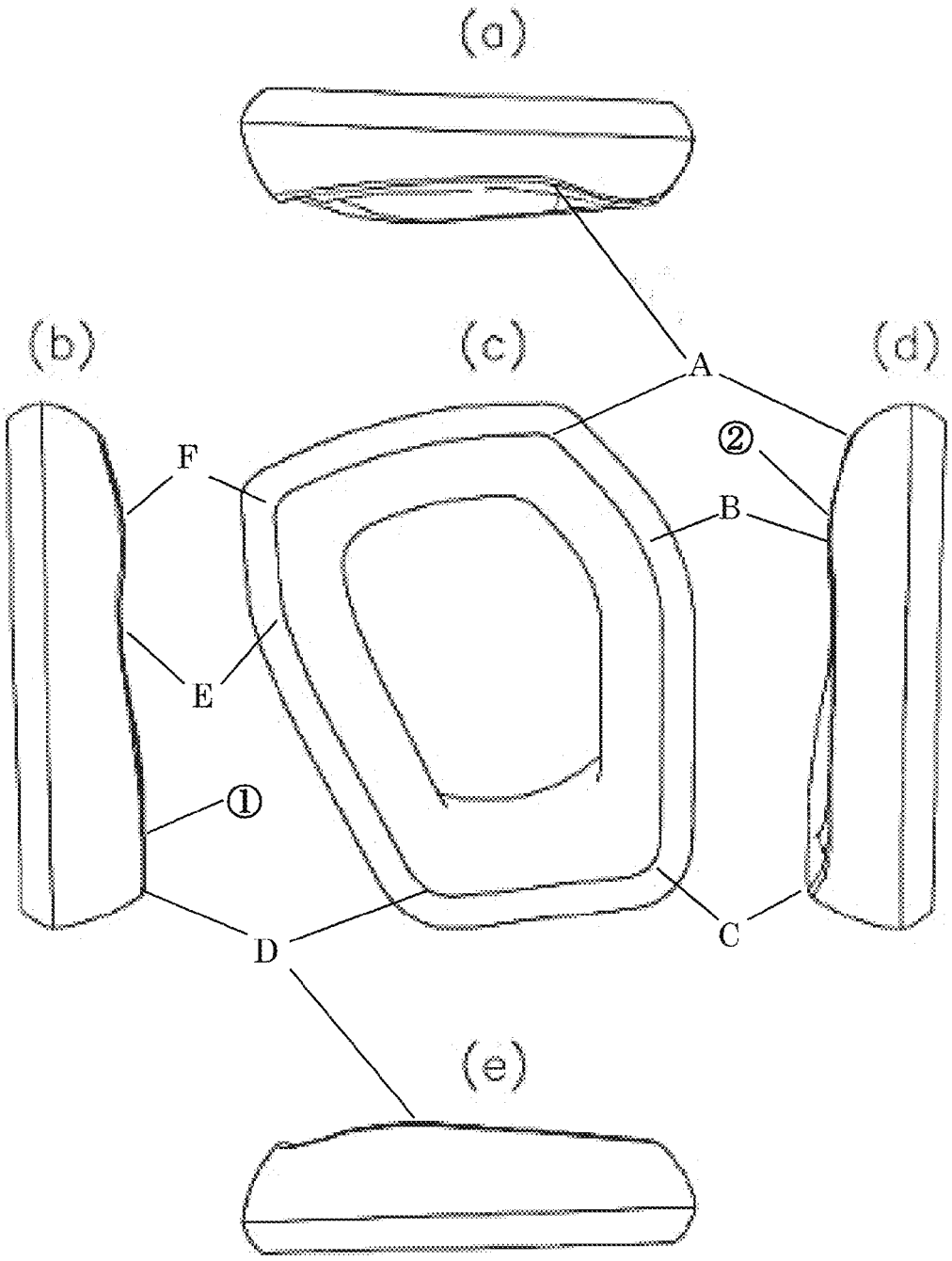
FIG. 2 are views illustrating a shape of a left ear pad of the headphone device according to the embodiment of the present invention.

FIG. 2 are views illustrating a shape of the left ear pad of the headphone device according to the embodiment of the present invention. FIG. 2(*a*) is a top view, FIG. 2(*b*) is a rear view, FIG. 2(*c*) is a front view of a fitting surface, FIG. 2(*d*) is a front view, and FIG. 2(*e*) is a bottom view.

Figure 3:
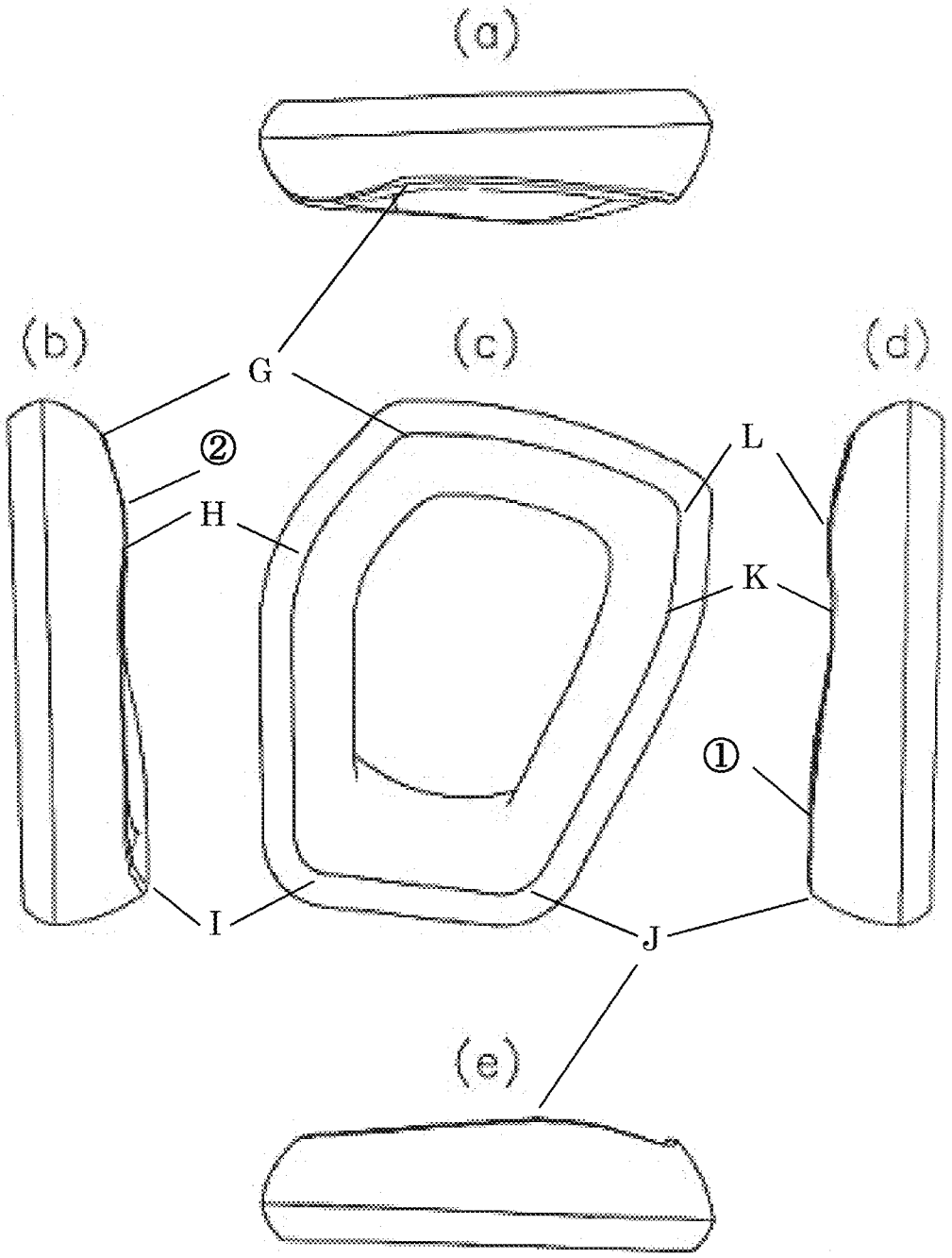
FIG. 3 are views illustrating a shape of a right ear pad of the headphone device according to the embodiment of the present invention.

FIG. 3 are views illustrating a shape of the right ear pad of the headphone device according to the embodiment of the present invention. FIG. 3(*a*) is a top view, FIG. 3(*b*) is a front view, FIG. 3(*c*) is a front view of a fitting surface, FIG. 3(*d*) is a rear view, and FIG. 3(*e*) is a bottom view.

The right and left housings are each formed into a substantially hexagonal shape, and the fitting surfaces thereof are formed into a curved surface having protrusions and depressions for closing gaps at the time of fitting.

When a flat ear pad is fitted, around the ear of the listener, gaps tend to be formed at a lower rear part of the ear on the head due to depressions at the base of the neck. As a measure therefor, on the fitting surface of the ear pad, a smooth protruding portion (see part (1) in FIGS. 2 and 3) is formed at a part corresponding to the lower rear part of the ear on the head so as to be softly fitted to the lower rear part of the ear of the user (lower left part in FIG. 2(*c*), and lower right part in FIG. 3(*c*)).

Around the ear of the listener, gaps tend to be formed at an upper front part of the ear on the head due to depressions that are formed by a temple part on a lateral side of the forehead and a cheek part. As a measure therefor, on the fitting surface of the ear pad, a smooth protruding portion (see part (2) in FIGS. 2 and 3) is formed at a part corresponding to the upper front part of the ear on the head so that the ear pad is softly fitted to the upper front part of the ear of the user (upper left part in FIG. 2(*c*), and upper right part in FIG. 3(*c*)).

When the protruding portion is formed on such ear pads at the part corresponding to the lower rear part or the upper front part of the ear of the user, gaps between the ear pads and the head can be closed without deteriorating wearing comfort of the headphones. As a result, sound leakage can be prevented.

Figure 4:
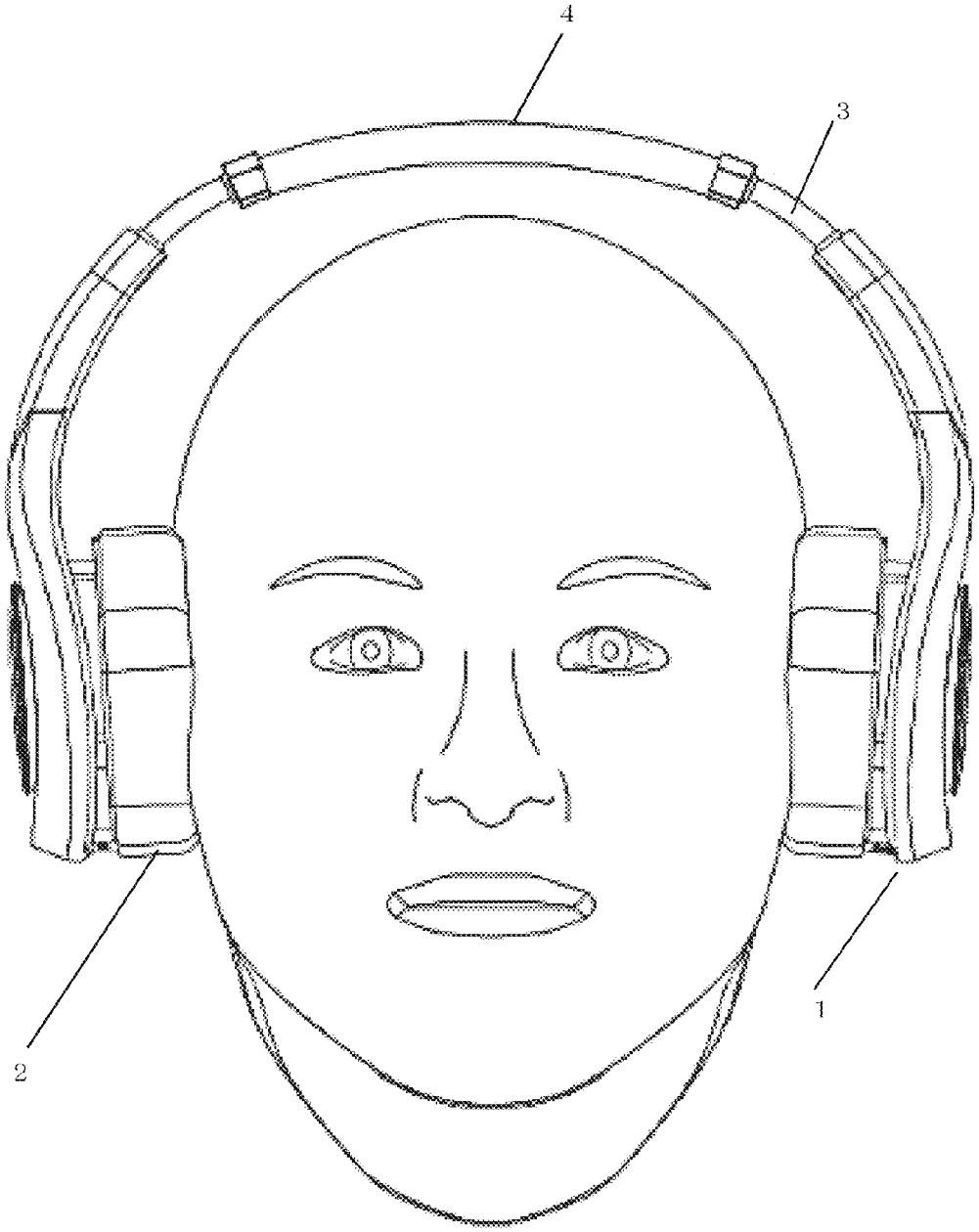
FIG. 4 is a view of a wearing state in which the ear pads of the headphone device are fitted in close contact with the head.
Figure 5:
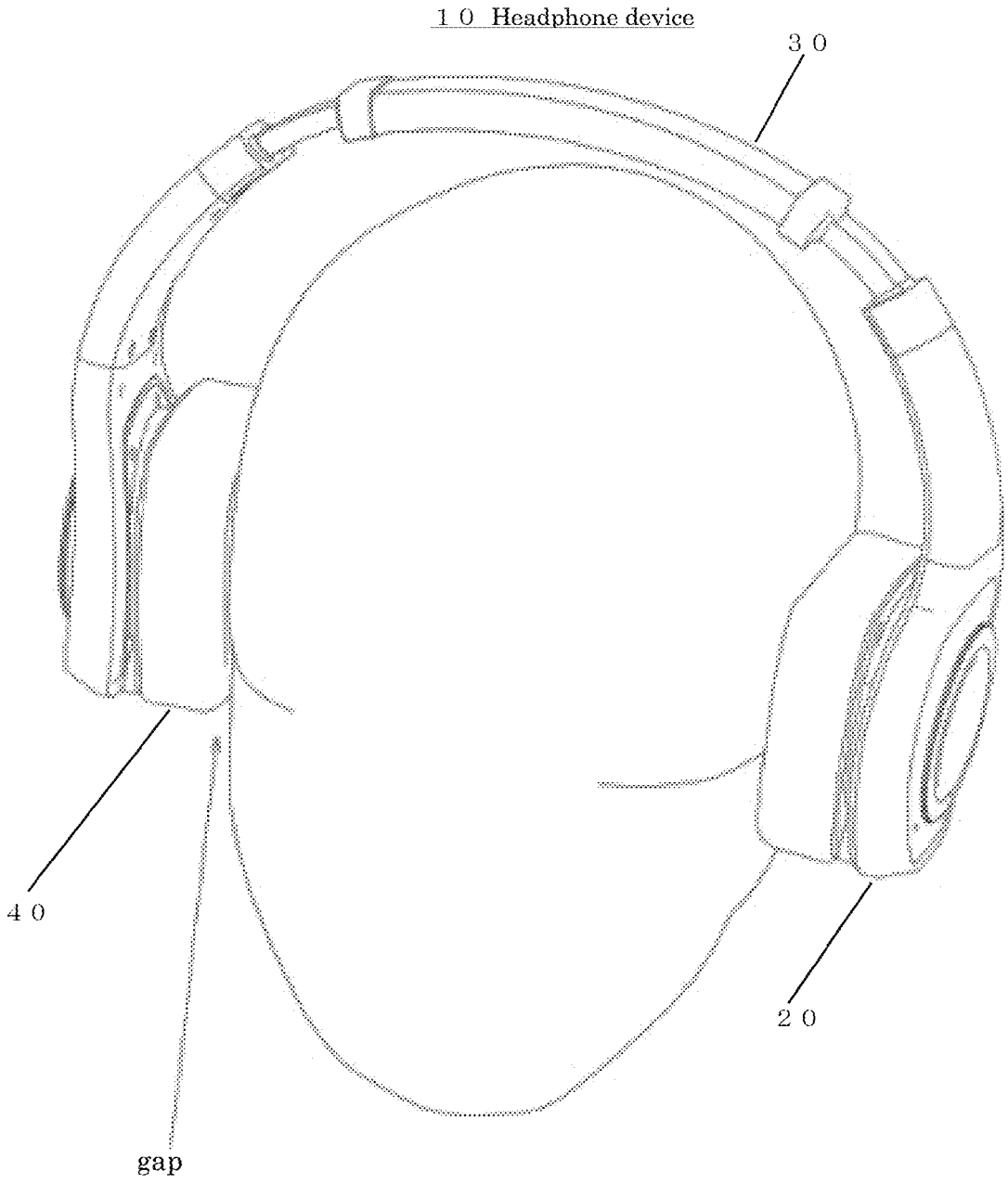
FIG. 5 is a view of an example of a wearing state in which an ear pad of a related-art headphone device forms a gap.

FIG. 4 is a view of a wearing state of the headphone device as viewed from the front of the head. There are ridges and depressions around the ears on the head. Thus, when the headphone device is attached to the head, protrusions and depressions (curved-surface shape) of the ear pads are fitted to peripheries of the ears on the head. With this, as illustrated in FIG. 4, boundaries of the head and the ear pads are brought into close contact with each other. As a result, sound leakage can be prevented.

The ear pads illustrated in FIGS. 2 and 3 are each formed into a substantially rounded hexagonal shape. In FIG. 2(*c*), rounded corners A to F are formed. In FIG. 3(*c*), rounded corners G to L are formed.

In each of the ear pads illustrated in FIGS. 2 and 3, an upper front side (A-B in FIG. 2(*c*) and G-H in FIG. 3(*c*)) is formed into a slope along which the fitting surface swells from top to bottom. Further, a lower front side (B-C in FIG. 2(*c*) and H-I in FIG. 3(*c*)) is formed into a substantially flat surface along which the fitting surface slightly shrinks from top to bottom. Meanwhile, the corner B in FIG. 2(*c*) and the corner H in FIG. 3(*c*) each form a peak of the protruding portion on the fitting surface.

In each of the ear pads illustrated in FIGS. 2 and 3, a lower side (C-D in FIG. 2(*c*) and I-J in FIG. 3(*c*)) is formed into a slope along which the fitting surface gently swells from front to rear.

In each of the ear pads illustrated in FIGS. 2 and 3, a lower rear side (D-E in FIG. 2(*c*) and J-K in FIG. 3(*c*)) is formed into a slope along which the fitting surface gently shrinks from bottom to top. Meanwhile, the corner D in FIG. 2(*c*) and the corner J in FIG. 3(*c*) each form a peak of the protruding portion on the fitting surface.

In each of the ear pads illustrated in FIGS. 2 and 3, an upper rear side (E-F in FIG. 2(*c*) and K-L in FIG. 3(*c*)) is formed into a slope along which the fitting surface gently swells from bottom to top. Meanwhile, the corner E in FIG. 2(*c*) and the corner K in FIG. 3(*c*) each form a bottom peak of a valley of a depressed portion on the fitting surface. The corner F in FIG. 2(*c*) and the corner L in FIG. 3(*c*) each form a peak of the protruding portion on the fitting surface.

In each of the ear pads illustrated in FIGS. 2 and 3, an upper side (F-A in FIG. 2(*c*) and L-G in FIG. 3(*c*)) is formed into a slope along which the fitting surface gently shrinks from rear to front. Meanwhile, the corner A in FIG. 2(*c*) and the corner G in FIG. 3(*c*) each form a bottom peak of a valley of a depressed portion on the fitting surface.

With the ear pad configuration as illustrated in FIGS. 2 and 3, a curved surface having protrusions and depressions is formed as a fitting surface of an elastic ear pad. With this, the fitting surface can be fitted to the periphery of the ear on the head of a user.

Thus, formation of gaps can be prevented between the periphery of the ear on the head of the user and the ear pad. With this, as illustrated in FIG. 4, boundaries of the head and the ear pads are fitted to each other. As a result, sound leakage and deterioration in sound quality can be prevented.

As described above, each side of a surface of the ear pad, which is held in contact with the head of the user, is inclined to be an upward or downward monotonic slope. Turning points from an upward direction to a downward direction, turning points from the downward direction to the upward direction, or turning points between inclination angles are provided correspondingly to the corner portions of the ear pad. With this, components of the ear pad can be separately manufactured into a simple shape, and assembled to each other. As a result, ear pads having a fitting surface including complicated protrusions and depressions that are easily fitted to the periphery of the ear of the user can be produced and assembled easily and at low cost.

INDUSTRIAL APPLICABILITY

The present invention is applicable to ear pads having an easy-to-fit shape, and also to comfortable headphones including the ear pads.

REFERENCE SIGNS LIST

1 housing
2 ear pad
3 pipe
4 head pad

The invention claimed is:

1. A headphone, comprising an ear pad fitted onto a surface of a housing, the housing comprising a built-in speaker driver for outputting an audio signal as sound, wherein the ear pad is formed into a polygonal shape and has a fitting surface for abutment on an ear of a listener, the ear pad having a front side corresponding to a face side of the listener, a rear side corresponding to a hack of a head side of the listener, an upper side corresponding to a top of the head of the listener, and a lower side corresponding to a bottom of the head of the listener, the ear pad comprising:

an upper front side formed into a curve along which the fitting surface curves outward from a top to bottom, the upper front side having an upper front protruding portion on the fitting surface which is to be brought into abutment on a periphery of the ear on an upper front part of a head of the listener; and a lower rear side formed into curve along which the fitting surface curves inward from bottom to top, the lower rear side having a lower rear protruding portion on the fitting surface which is to be brought into abutment on a periphery of the ear on a lower rear part of a head of the listener.

2. The headphone of claim 1, wherein the polygonal shape comprises a monotonic slope formed on a fitting surface on one side of the polygonal shape.

3. The headphone of claim 2, wherein the polygonal shape comprises corners each corresponding to a peak between curves of two sides that form corresponding one of the corners.

4. The headphone of claim 2, wherein the polygonal shape comprises corners each corresponding to a turning point between curves of two sides that form corresponding one of the corners.

5. The headphone of claim 1, further comprising a lower front side formed into a substantially flat surface along which the fitting surface tapers from top to bottom.

6. The headphone of claim 5, further comprising an upper front corner connecting the upper front side and lower front side, the upper front corner forming a peak of the upper front protruding portion on the fitting surface.

7. The headphone of claim 1, further comprising a lower side formed into a curve along which the fitting surface curves outward from front to rear.

8. The headphone of claim 1, further comprising a lower rear side formed into a curve along which the fitting surface curves inward from bottom to top.

9. The headphone of claim 8, further comprising a lower rear corner connecting the lower side and lower rear side, the lower rear corner forming a peak of the lower rear protruding portion on the fitting surface.

10. The headphone of claim 1, further comprising an upper rear side formed into a curve along which the fitting surface curves outward from bottom to top.

11. The headphone of claim 10, further comprising a rear corner connecting the lower rear side and upper rear side, the rear corner forming a bottom peak of a valley of a rear depressed portion on the fitting surface.

12. The headphone of claim 1, further comprising an upper side formed into a curve along which the fitting surface curves inward from rear to front.

13. The headphone of claim 12, further comprising an upper rear corner connecting the upper rear side and the upper side, the upper rear corner forming a peak of an upper rear protruding portion on the fitting surface.

14. The headphone of claim 12, further comprising an upper corner connecting the upper side and the upper front side, the upper corner forming a bottom peak of a valley of an upper depressed portion on the fitting surface.

15. A headphone, comprising an ear pad fitted onto a surface of a housing, the housing comprising a built-in speaker driver for outputting an audio signal as sound, wherein the ear pad is formed into a polygonal shape and has a fitting surface for abutment on an ear of a listener, the ear pad having a front side corresponding to a face side of the listener, a rear side corresponding to a back of a head side of the listener, an upper side corresponding to a top of the head of the listener, and a lower side corresponding to a bottom of the head of the listener, the ear pad comprising:

an upper front side formed into a curve along which the fitting surface curves outward from a top to bottom, the upper front side having an upper front protruding portion on the fitting surface which is to be brought into abutment on a periphery of the ear on an upper front part of a head of the listener;

a lower rear side formed into a curve along which the fitting surface curves inward from bottom to top, the lower rear side having a lower rear protruding portion on the fitting surface which is to be brought into abutment on a periphery of the ear on a lower rear part of a head of the listener;

a lower front side formed into a substantially flat surface along which the fitting surface tapers from top to bottom;

an upper front corner connecting the upper front side and lower front side, the upper front corner forming a peak of the upper front protruding portion on the fitting surface;

a lower side formed into a curve along which the fitting surface curves outward from front to rear;

a lower rear side formed into a curve along which the fitting surface curves inward from bottom to top;

a lower rear corner connecting the lower side and lower rear side, the lower rear corner forming a peak of the lower rear protruding portion on the fitting surface;

an upper rear side formed into a curve along which the fitting surface curves outward from bottom to top;

a rear corner connecting the lower rear side and upper rear side, the rear corner forming a bottom peak of a valley of a rear depressed portion on the fitting surface;

an upper side formed into a curve along which the fitting surface curves inward from rear to front;

an upper rear corner connecting the upper rear side and the upper side, the upper rear corner forming a peak of an upper rear protruding portion on the fitting surface; and an upper corner connecting the upper side and the upper front side, the upper corner forming a bottom peak of a valley of an upper depressed portion on the fitting surface.

* * * * *